US005672262A

United States Patent [19]

Johnson et al.

[11] Patent Number: 5,672,262

[45] Date of Patent: Sep. 30, 1997

[54] METHODS AND ELECTROLYTE COMPOSITIONS FOR ELECTRODEPOSITING METAL-CARBON ALLOYS

[75] Inventors: Christian E. Johnson, Middletown; David Lashmore, Frederick; Elaine Soltani, Olney, all of Md.

[73] Assignee: The United States of America, as represented by the Secretary of Commerce, Washington, D.C.

[21] Appl. No.: 411,191

[22] Filed: Mar. 27, 1995

Related U.S. Application Data

[62] Division of Ser. No. 107,883, Aug. 18, 1993, Pat. No. 5,415,763.

[51] Int. Cl.[6] ..... C25D 3/00

[52] U.S. Cl. ..... 205/255; 205/256; 205/259; 205/260; 205/270; 205/272; 205/273; 205/227

[58] Field of Search ..... 205/238, 255, 205/259, 260, 273, 270, 271, 227, 256, 272

[56] References Cited

U.S. PATENT DOCUMENTS

| | | | |
|---|---|---|---|
| 2,802,779 | 8/1957 | Cowle et al. | 205/255 |
| 2,927,066 | 3/1960 | Schaer | 204/43 |
| 3,111,464 | 11/1963 | Safranek, Jr. et al. | 205/287 |
| 3,360,445 | 12/1967 | Tobar | 205/255 |
| 3,489,660 | 1/1970 | Semienro et al. | 205/255 |
| 3,671,409 | 6/1972 | Barrett | 205/255 |
| 3,886,053 | 5/1975 | Leland | 204/51 |
| 3,888,744 | 6/1975 | Stromatt et al. | 204/115 |
| 3,954,574 | 5/1976 | Gyllenspetz et al. | 204/51 |
| 3,985,784 | 10/1976 | Glauss et al. | 205/176 |
| 4,053,374 | 10/1977 | Crowther | 204/51 |
| 4,054,494 | 10/1977 | Gyllenspetz et al. | 205/287 |
| 4,167,460 | 9/1979 | Tomaszewski | 204/51 |
| 4,256,548 | 3/1981 | Barclay et al. | 204/51 |
| 4,461,680 | 7/1984 | Lashmore | 204/51 |
| 4,543,167 | 9/1985 | Seyb, Jr. et al. | 204/51 |
| 4,755,265 | 7/1988 | Young | 204/45.1 |
| 4,804,446 | 2/1989 | Lashmore et al. | 204/51 |
| 5,167,791 | 12/1992 | Herber et al. | 205/67 |
| 5,171,419 | 12/1992 | Wheeler et al. | 205/255 |
| 5,352,266 | 10/1994 | Erb et al. | 205/274 |

*Primary Examiner*—Kathrn L. Gorgos
*Assistant Examiner*—Kishor Mayekar
*Attorney, Agent, or Firm*—Lowe, Price, LeBlanc & Becker

[57] ABSTRACT

Methods for electrodepositing a metal-carbon coating on a substrate comprising immersing the substrate in an aqueous electrolyte, and passing a sufficient current through the electrolyte to effect electrolyte deposition of a metal-carbon alloy on the substrate. The aqueous electrolyte comprises from about 0.2 to about 0.6 mol/l of metal ions selected from the group consisting of iron, nickel, nickel-tungsten mixture and cobalt-tungsten mixture, greater than about 1.4 mol/l of an amidosulfonic acid or a salt thereof, ammonium ions, formic acid or a salt thereof, and water.

21 Claims, No Drawings

METHODS AND ELECTROLYTE COMPOSITIONS FOR ELECTRODEPOSITING METAL-CARBON ALLOYS

This application is a division of application Ser. No. 08/107,883, filed Aug. 18, 1993, now U.S. Pat. No. 5,415,763.

FIELD OF THE INVENTION

The present invention relates to methods and compositions for electrodepositing chromium coatings. The methods and compositions of the invention are particularly directed to electrodepositing functional chromium coatings having a thickness of greater than about 150 μm from aqueous electrolyte solutions using a trivalent chromium ion source. The methods and processes may also be employed to produce thin, decorative chromium coatings.

BACKGROUND OF THE INVENTION

Chromium is widely used as an electrochemically applied coating on metal to provide wear resistance and/or reduce friction, or to affect a desired appearance. Conventionally, chromium is deposited from an electrolyte in which the chromium is in the hexavalent ($Cr^{+6}$) state. Such depositions are disadvantageous in that they require expensive waste treatment procedures to reduce, if not eliminate, toxic and suspected carcinogenic waste products. Additionally, the cathode current efficiency of hexavalent chromium is experimentally found to be in a range of only 8 to 15%, depending on the type of electrolyte, because of the energy required to overcome a semi-protective cathode film before metal is deposited. At these current efficiencies, the electrochemical equivalent of chromiumdeposited from the hexavalent state ranges from 7.2 to 13.5 μm/amps.

Chromium is rarely deposited commercially from

These and additional objects are provided by the methods and compositions of the present invention. According to the present invention, methods for electrodepositing a chromium coating on a substrate comprise immersing the substrate in an aqueous electrolyte and passing a sufficient current through the electrolyte to effect deposition of a chromium coating on the substrate. The aqueous electrolyte solution comprises from about 0.2 to about 0.6 mol/l of trivalent chromium ions ($Cr^{+3}$), greater than about 1.4 mol/l of an amidosulfonic acid or a salt thereof, ammonium ions, formic acid or a salt thereof and water. The present methods, and the aqueous electrolyte solutions employed therein, provide functional chromium coatings having a thickness of at least 150 μm. Additionally, cathode current efficiencies in the range of from 12–35 percent may be obtained.

These and additional objects and advantages provided by the present methods and compositions will be more fully apparent in view of the following detailed description.

DETAILED DESCRIPTION

The methods and compositions of the present invention are particularly suitable for use in preparing functional chromium coatings having thicknesses greater than about 150 μm. In fact, the present methods and compositions have been employed to form chromium coatings having thicknesses up to 500 μm. The methods comprise immersing a substrate to be coated in an aqueous electrolyte solution and passing a sufficient current through the solution to effect deposition of a chromium coating on the substrate. The substrate may be any suitable metal part or the like on which a chromium coating is desired. Generally, the aqueous electrolyte solution comprises from about 0.2 to about 0.6 mol/l of trivalent chromium ions, greater than about 1.4 mol/l of an amidosulfonic acid or a salt thereof, ammonium ions, formic acid or a salt thereof, and water.

The trivalent chromium ions are provided by trivalent chromium salts or other chromium compounds known in the art. For example, the chromium ions may be provided in the form of chromic sulfate, chromic chloride, potassium chromium sulfate, or mixtures thereof. Preferably, the trivalent chromium source has a low iron content, for example, 20 ppm or less. If the trivalent chromium source has high amounts of iron impurity, for example 200 ppm or more, the iron may cause dark areas to appear in the chromium deposit. In another preferred embodiment, the trivalent chromium source includes sulfate ions and/or an additional source of sulfate ions, for example ammonium sulfate, is included in the electrolyte solution. Applicants have determined that the presence of sulfate ions in the electrolyte solution assists in the suppression of undesirable precipitate formation. It will be apparent that the suppression of the formation of precipitates is important in the deposition of the trivalent chromium coatings.

The amidosulfonic acid or salt thereof which is included in the aqueous electrolyte solutions of the present invention serves as a secondary complexing agent for the trivalent chromium ions and for other metallic impurities that may be present in the electrolyte. Complexing agents which have been employed in the prior art often, and undesirably, participate in anodic reactions. The amidosulfonic acid or salts thereof avoid this problem. In a preferred embodiment, an amidosulfonic acid salt, i.e., an amidosulfonate, is employed. Suitable amidosulfonates include alkali metal sulfamates such as sodium and potassium sulfamates, ammonium sulfamate, and mixtures thereof.

Ammonium ions are included in the electrolyte as a bright range extender. Ammonium ions may be included in trivalent electrolytes because most commercial processes are only capable of producing coatings of limited thicknesses, i.e. of 2.5 μm or less. Such coatings are not as resistant to wear and have a different surface appearance compared with coatings produced from the widely used hexavalent chromium. Another problem in the deposition of chromium from the trivalent state is the anodic reaction which usually causes the oxidation of $Cr^{+3}$ to $Cr^{+6}$. This oxidation results in reduced current efficiency and increases in waste treatment costs. Undesired oxidation has been addressed in commercial trivalent chromium systems by isolating the anodic reaction chamber with appropriate barriers such as an ion selective membrane or a ceramic barrier or by using an anolyte different in composition from the bulk electrolyte. The oxidation reaction can be selected to be bromine or chlorine evolution, which occurs at a lower anodic potential than does $Cr^{+3}$ oxidation. However, such solutions are disadvantageous owing to the generation of toxic halide gases.

Accordingly, a need exists for improved methods and compositions for electrodepositing chromium coatings.

SUMMARY OF THE INVENTION

It is therefore an object of the present invention to provide improved methods and electrolyte compositions for electrodepositing chromium coatings. It is a more specific object of the invention to provide methods and compositions for electrodepositing functional chromium coatings having thicknesses greater than about 150 μm. It is a further object of the invention to provide methods and compositions for electrodepositing chromium coatings using trivalent chromium sources. It is another object of the invention to provide methods and compositions for electrodepositing chromium coatings wherein an increased cathode current efficiency may be obtained. an amount from about 1.0 to about 4.0 mol/l. More preferably, the ammonium ions are included in an amount of greater than about 3.0 mol/l. With the larger concentrations of ammonium ions, the range of current densities for the deposition of bright deposits was extended from about 160–240 ma/cm$^2$ to a range of from 65 to greater than 320 ma/cm$^2$. For example, at the lower ammonium concentration of from about 1.0 to about 1.8 mol/l, the bright range persisted for a current density range of 100 ma/cm$^2$. At the higher concentration of about 3.0 to about 3.8 mol/l, the bright range was apparent from 60 to greater than 320 ma/cm$^2$. This effect is discernable with Hull Cell studies. The ammonium ions in the electrolyte also assist in the oxidation reaction which occurs at the anode. The ammonium ions may be provided in various forms including ammonium sulfate, ammonium halides, ammonium sulfamate, or mixtures thereof. In a preferred embodiment, ammonium ions are provided at least in part in the form of ammonium chloride which acts as a conductivity salt as well.

The formic acid or a salt thereof which is included in the aqueous electrolytes of the present invention provides formate ions which serve several functions. That is, the formate ions form a complex with the chromium, thereby enabling the reduction of metallic chromium at a reasonable current efficiency. The formate ions also suppress the hexa-aquochloride complex, thereby promoting the chromium reduction. The formate ion also acts as a buffer. In a preferred embodiment, the formic acid or salt thereof is included in an amount of greater than about 1.5 mol/l. It is believed that this content of formate ions in the electrolyte prevents the pH of the cathodic diffusion layer from exceeding 3.5. The formate ions also serve as a reducing agent and therefore assist in avoiding the formation of hexavalent chromium. Moreover, the inventors have determined that the deposits obtained from the present methods and compositions generally comprise chromium-carbon alloys, whereby the formate ions serve as a source for carbon in the deposits, either directly as an absorbed molecule or indirectly as an absorbed species from the reduction of the formate ions.

In one embodiment, the anode employed in the electrodeposition methods of the invention comprises carbon, platinum, or platinized titanium, and chloride ions are included in the electrolyte solution in order to suppress the oxidation of the trivalent chromium ions to the hexavalent chromium form. On the other hand, as will be discussed in detailed below, if bromine is present, other anodes may be employed and the chloride ions are not required. To some extent, bromine gas formed at the anode will redissolve in the electrolyte before being released into the air.

The aqueous electrolytes employed in the present invention may include further components, if desired. For example, in one embodiment, the solutions may include boric acid. The boric acid may act as an electron bridge to catalyze the reduction process and may be effective in extending the bright range of deposition. The boric acid, when employed, is preferably included in an amount of from about 0.4 to about 0.6 mol/l.

In another embodiment, a bromine ion source may also be included in the electrolyte in order to assist in preventing the anodic oxidation of trivalent chromium to hexavalent chromium. In acid regimes, the anodic reaction order, in order of energy of activation, is bromine evolution, chlorine evolution and oxygen evolution. If trivalent chromium is present, the trivalent chromium will oxidize to hexavalent chromium. However, the bromine ions will prevent such oxidation. On the other hand, when employing platinum anodes, chlorine will evolve before trivalent chromium oxidizes to hexavalent chromium. Thus, bromine is preferably included in the electrolyte solutions if the solutions do not contain chloride ions and if platinum or platinized titanium anodes are not used. On the other hand, bromine ions can be eliminated from the electrolyte solution along as chloride is present in the solution and platinum or platinized titanium anodes are used. The bromine ions, when employed, are preferably included in an amount of from about 0.05 to about 0.25 mol/l.

The aqueous electrolyte may further include a wetting agent (surfactant). Surfactants which are typically used in hexavalent chromium electrolytes are suitable for use in the aqueous electrolytes of the present invention. Suitable wetting agents (surfactants) include, but are not limited to, polyethylene glycol ethers, for example, polyethylene glycol ethers of alkyl-phenols, sulfosuccinates, alkyl benzene sulfonates, alkyl sulfonates, mixtures thereof and the like. The wetting agents (surfactants) may be included in the electrolytes in conventional amounts.

In preferred embodiments of the methods of the present invention, the electrodeposition is conducted at solution temperatures of from about 20° to about 50° C. The present inventors have discovered that increasing the electrolyte temperature from 22° to 50° C. results in a shift of the bright range to higher current densities by at least a factor of 2. In another preferred embodiment, the methods for electrodeposition are effected at a pH of from about 1.0 to about 4.0. More preferably, the methods are conducted at a pH of from about 1.5 to about 3.3. The present inventors have discovered that increasing the pH from about 1.5 to about 3.3 results in the shift of the bright range of deposition to lower current densities. However, an accompanying narrowing and finally loss of bright range can occur when the pH is increased significantly above 3.5. On the other hand, decreasing the pH below about 1.0 may shift the bright range to higher current densities.

In the present methods, the cathode current efficiency increases with increasing current density in a manner similar to that found with hexavalent chromium deposition. This increase in efficiency is opposite to that of the prior art relating to deposition of trivalent chromium. As indicated above, the present methods result in a broad range of current densities, i.e. from about 65 to greater than 320 ma/cm$^2$, for deposition of bright chromium deposits. The formation of dark streaks or dark areas on the plated surface which have incurred in prior art electrodeposited coatings are also avoided in the present methods.

The trivalent chromium deposits produced according to the present invention are microcracked and amorphous in structure. In fact, x-ray diffraction and differential scanning calorimetry data have shown that the deposits have a glass-like structure. It is believed that the deposits are actually chromium-carbon-oxygen-hydrogen alloys. These deposits may be transformed to a crystalline structure of chromium-chromium carbide, specifically chromium carbide in a chromium matrix, after heat treatment at temperatures greater than about 500° C. and, more preferably, greater than about 650° C. Both the hardness and the wear resistance of the coatings may be significantly increased by such a heat treatment. For example, the as-deposited chromium coating hardness of about 750 Knoop or Vickers can be increased to about 1800 with such a heat treatment. The wear rate of the as-deposited coatings in a dry sliding environment against sintered tungsten carbide (WC) was ⅛ (12%) that of the tungsten carbide. In lubricated abrasive wear, the as-deposited trivalent chromium deposits wore at a rate approximately 3.7 times faster than hexavalent chromium coatings, but wore at one-half to one-fourth the rate of the hexavalent chromium coatings after heat treatment.

EXAMPLE

The following aqueous electrolyte compositions have been employed to electrodeposit chromium coatings having thicknesses greater than 150 μm:

| | |
|---|---|
| Electrolyte I: | |
| $CrCl_3 \cdot {}_{6H2}O$ | 0.47 mol/l (125 g/l) |
| $KCr(SO_4)_2 \cdot 12H_2O$ | 0.05 mol/l (25 g/l) |
| $NH_4NH_2SO_3$ | 1.56 mol/l (178 g/l) |
| $NH_4Cl$ | 1.50 mol/l (80 g/l) |
| KBr (optional) | 0.13 mol/l (15 g/l) |
| $H_3BO_3$ | 0.50 mol/l (31 g/l) |
| HCOOH (88–95%) | 1.60 mol/l (60 ml/l) |
| or | |
| $NH_4COOH$ (with deletion of $NH_4Cl$) | 1.60 mol/l (100 g/l) |
| pH | 2.5 (adjusted with $H_2SO_4$, HCl, $HNH_2SO_3$, or KOH) |
| Electrolyte II: | |
| $Cr_2(SO_4)_3 \cdot 8.5H_2O$ | 0.2 mol/l (109 g/l) |
| $KCr(SO_4)_2 \cdot 12H_2O$ | 0.05 mol/l (25 g/l) |
| $NH_4NH_2SO_3$ | 1.40 mol/l (160 g/l) |
| $(NH_4)_2SO_4$ | 0.75 mol/l (100 g/l) |
| $H_3BO_3$ | 0.50 mol/l (31 g/l) |
| HCOOH (88–95%) | 1.60 mol/l (60 ml/l) |
| or | |
| $NH_4COOH$ | 1.60 mol/l (100 g/l) |
| pH | 2.5 (adjusted with $H_2SO_4$, $HM_2SO_3$, or KOH) |

Generally, the highest current efficiencies (30 and 34%) were obtained from a mixed chloride/sulfate/sulfamate electrolyte operated at a pH of 1.5 and 21° C. at current densities of 125 and 175 ma/cm$^2$, respectively. This electrolyte contained ammonium ion in a 1.5 mol/l concentration. The bright plating range was not as broad (100 to 200 ma/cm$^2$) as the range which was achieved when the higher ammonium concentration (3–3.5 mol/l) was used. The use of the higher ammonium concentration and an increase of pH from 1.5 to 2.5 resulted in lower cathode current efficiencies (15 to 23%) for the same current densities even though the bright range was extended (60 to 20 ma/cm$^2$). The decrease in current efficiency was not expected at the higher bulk electrolyte pH of 2.5 since it was noted that the efficiency increases with an increase in current density where it is assumed that the pH in the vicinity of the cathode also increases. The increase in pH also results in an increase in the degree of complexation of the chromium with formate and sulfamate ions which would result in a lower current efficiency. However, the rate of hydrogen evolution would decrease with increasing pH which in turn would result in higher current efficiencies for chromium deposition. The rate of increasing complexation may be greater than the decrease in hydrogen evolution as pH increases, thus resulting in lower current efficiencies. One possibility is that the trivalent chromium deposition is associated with the hydrogen evolution, indicating that hydrogen reduction of chromium ions to metal or the reduction of $Cr^{+3}$ to $Cr^{+2}$ may be taking place. This could explain (1) the increase in current efficiency with increasing current density since the hydrogen evolution also increases; and (2) the decrease in current efficiency with increasing electrolyte pH since the hydrogen evolution decreases. However, the present inventors do not intend to be limited by this theory. In any event, hydrogen gas and/or hydride formation can be suppressed by pulsing the potential or current into a region where hydrogen is oxidized. It was shown experimentally that cathode current efficienty decreases when pulsing the potential or current. It was also shown experimentally that cathode current efficiency decreases with increasing rotational speed when using a rotating cylindrical cathode. Both of these experiments affect hydrogen evolution by either oxidizing the hydrogen or sweeping hydrogen away from the substrate surface.

In alternate embodiments, the methods and compositions of the present invention can be employed to form alloys of carbon and a metal other than chromium when the trivalent chromium ions in the aqueous electrolyte solution are replaced by another compound containing, for example, iron, nickel, nickel-tungsten, cobalt-tungsten or other carbide-forming metal.

These example compositions are set forth to illustrate specific embodiments of the invention and are not intended to limit the scope of the methods and compositions of the present invention. Additional embodiments and advantages within the scope of the claimed invention will be apparent to one of ordinary skill in the art.

What is claimed is:

1. A method for electrodepositing a metal-carbon alloy coating on a substrate, comprising immersing the substrate in an aqueous electrolyte, and passing a sufficient current through the electrolyte to effect deposition of a metal-carbon alloy coating on the substrate, the aqueous electrolyte comprising from about 0.2 to about 0.6 mol/l of ions of metal selected from the group consisting of iron, nickel, nickel-tungsten mixture, and cobalt-tungsten mixture as a source of the metal in the deposit, greater than about 1.4 mol/l of an amidosulfonic acid or a salt thereof, ammonium ions, formic acid or a salt thereof as a source of carbon in the deposit, and water.

2. A method as defined by claim 1, wherein the metal-carbon alloy coating has a thickness of at least 150 μm.

3. A method as defined by claim 1, wherein the amidosulfonic acid salt is selected from the group consisting of an alkali metal sulfamate, an ammonium sulfamate, and a mixture thereof.

4. A method as defined by claim 1, wherein the ammonium ions are provided in the form of ammonium sulfate, ammonium halide, ammonium sulfamate, or mixtures thereof.

5. A method as defined by claim 4, wherein the ammonium ions are included in an amount of from about 1.0 to about 4.0 mol/l.

6. A method as defined by claim 4, wherein the ammonium ions are included in an amount of greater than about 3.0 mol/l.

7. A method as defined by claim 1, wherein the formic acid or salt thereof is included in an amount of greater than about 1.5 mol/l.

8. A method as defined by claim 1, wherein the electrolyte further includes sulfate ions.

9. A method as defined by claim 1, wherein the electrolyte further includes boric acid.

10. A method as defined by claim 9, wherein the boric acid is included in an amount of from about 0.4 to about 0.6 mol/l.

11. A method as defined by claim 1, wherein the electrolyte further includes bromine ions.

12. A method as defined by claim 11, wherein the bromine ions are included in an amount of from about 0.05 to about 0.25 mol/l.

13. A method as defined by claim 1, wherein the electrolyte further includes a wetting agent.

14. A method as defined by claim 13, wherein the wetting agent is selected from the group consisting of polyethylene glycol ethers, sulfosuccinates, alkyl benzene sulfonates, alkyl sulfonates, and mixtures thereof.

15. A method as defined by claim 1, wherein the electrolyte has a pH of from about 1.0 to about 4.0.

16. A method as defined by claim 1, wherein the electrolyte has a temperature of from about 20° to about 50° C.

17. A method as defined by claim 1, wherein a current density of from about 60 to about 320 $ma/cm^2$ is employed.

18. A method as defined by claim 1, wherein an anode is provided in the aqueous electrolyte, the anode is formed of carbon, platinum, or platinized titanium, and the aqueous electrolyte further includes chloride ions.

19. A method as defined by claim 1, including the further step of heat treating the metal-carbon alloy coating at a temperature greater than about 500° C.

20. A method as defined by claim 1, including the further step of heat treating the metal-carbon alloy coating at a temperature greater than about 650° C.

21. A method as defined by claim 1, wherein a potential or current is pulsed into a region where hydrogen is oxidized.

* * * * *